US011131115B2

(12) United States Patent
Carabalona et al.

(10) Patent No.: US 11,131,115 B2
(45) Date of Patent: Sep. 28, 2021

(54) COMPRESSION LATCH WITH KEY HOLDING

(71) Applicant: Southco, Inc., Concordville, PA (US)

(72) Inventors: Eric Carabalona, Warwickshire (GB); David Winwood Preston, Worcestershire (GB)

(73) Assignee: Southco, Inc., Concordville, PA (US)

( * ) Notice: Subject to any disclaimer, the term of this patent is extended or adjusted under 35 U.S.C. 154(b) by 230 days.

(21) Appl. No.: 16/344,877

(22) PCT Filed: Oct. 18, 2017

(86) PCT No.: PCT/US2017/057076
§ 371 (c)(1),
(2) Date: Apr. 25, 2019

(87) PCT Pub. No.: WO2018/080858
PCT Pub. Date: May 3, 2018

(65) Prior Publication Data
US 2020/0048929 A1 Feb. 13, 2020

Related U.S. Application Data

(60) Provisional application No. 62/413,080, filed on Oct. 26, 2016.

(51) Int. Cl.
*E05B 11/02* (2006.01)
*E05B 17/00* (2006.01)
(Continued)

(52) U.S. Cl.
CPC ..... *E05B 11/02* (2013.01); *E05B 9/02* (2013.01); *E05B 15/006* (2013.01);
(Continued)

(58) Field of Classification Search
CPC ... E05B 9/02; E05B 9/08; E05B 11/02; E05B 17/00; E05B 17/0025; E05B 35/008;
(Continued)

(56) References Cited

U.S. PATENT DOCUMENTS 4,583,775 A * 4/1986 Bisbing ..... E05B 17/0025 292/64
4,671,547 A 6/1987 Weinerman
(Continued)

FOREIGN PATENT DOCUMENTS

GB 2500979 A 10/2013
JP 0515529 A 1/1993
(Continued)

OTHER PUBLICATIONS

International Search Report and Written Opinion for International Application No. PCT/US2017/057076 dated Jan. 31, 2018, 11 Pages.
(Continued)

*Primary Examiner* — Christopher J Boswell
(74) *Attorney, Agent, or Firm* — RatnerPrestia

(57) ABSTRACT

Latches are disclosed. One latch includes a housing, a cap, a bushing, and a ball. The housing is configured for engagement to the panel. The housing has a longitudinal axis and defines an aperture along the longitudinal axis. The aperture includes a cutout area. The cap and the bushing are mounted within the aperture for rotation about the longitudinal axis. The cap comprises an outer surface including a drive projection and a cutout area. The bushing comprises an upper surface and a sidewall positioned between the cap and the housing. The sidewall defines a drive surface positioned to contact the drive projection of the cap and an opening. The ball is positioned within the opening of the bushing. The ball
(Continued)

is configured to be positioned at least partially within the cutout area of the housing or the cutout area of the cap.

14 Claims, 16 Drawing Sheets

(51) Int. Cl.

| | |
|---|---|
| ***E05B 9/02*** | (2006.01) |
| ***E05B 35/00*** | (2006.01) |
| ***E05C 3/04*** | (2006.01) |
| ***E05C 3/14*** | (2006.01) |
| ***E05B 15/00*** | (2006.01) |
| ***E05C 5/04*** | (2006.01) |
| ***E05B 17/20*** | (2006.01) |

(52) U.S. Cl.
CPC ..... *E05B 17/0025* (2013.01); *E05B 17/2011* (2013.01); *E05B 35/008* (2013.01); *E05C 3/042* (2013.01); *E05C 3/145* (2013.01); *E05C 5/04* (2013.01)

(58) Field of Classification Search
CPC ..... E05B 65/02; E05B 9/04; E05B 15/006; E05B 17/2011; E05C 3/04; E05C 3/042; E05C 3/045; E05C 3/14; E05C 3/145; E05C 5/02; E05C 5/04
See application file for complete search history.

(56) References Cited

U.S. PATENT DOCUMENTS

| | | | | |
|---|---|---|---|---|
| 4,878,367 | A * | 11/1989 | Bisbing | E05B 35/008 70/491 |
| 5,961,162 | A * | 10/1999 | Glaser | E05B 9/08 292/198 |
| 6,012,693 | A | 1/2000 | Voeller et al. | |
| 6,058,752 | A * | 5/2000 | Feder | E05B 15/08 70/419 |
| 6,640,592 | B2 * | 11/2003 | Vickers | E05B 17/04 70/127 |
| 7,338,022 | B2 | 3/2008 | Hung et al. | |
| 7,389,965 | B2 | 6/2008 | Oddsen, Jr. et al. | |
| 7,395,995 | B2 | 7/2008 | Chen | |
| 7,441,427 | B2 * | 10/2008 | Vickers | E05B 17/0025 70/127 |
| 7,540,457 | B2 | 6/2009 | Oddsen, Jr. et al. | |
| 7,604,210 | B2 | 10/2009 | Oddsen, Jr. et al. | |
| 7,694,927 | B2 | 4/2010 | Chuang | |
| 7,748,666 | B2 | 7/2010 | Oddsen, Jr. et al. | |
| 8,070,114 | B2 | 12/2011 | Chen | |
| 8,074,949 | B2 | 12/2011 | Oddsen, Jr. et al. | |
| 8,328,151 | B2 | 12/2012 | Gwag | |
| 8,366,060 | B2 | 2/2013 | Hung | |
| 8,469,323 | B1 | 6/2013 | Deros et al. | |
| 8,720,838 | B2 | 5/2014 | Bowman et al. | |
| 9,266,243 | B2 | 2/2016 | Swartz et al. | |
| 9,706,843 | B2 | 7/2017 | Hung | |
| 10,309,578 | B2 | 6/2019 | Yen et al. | |
| 10,753,529 | B2 | 8/2020 | Hung | |
| 10,845,000 | B2 | 11/2020 | Lau | |
| 10,948,946 | B2 | 3/2021 | Borloz et al. | |
| 11,054,062 | B2 | 7/2021 | Hung | |
| 2002/0166353 | A1 | 11/2002 | Vickers | |
| 2006/0236732 | A1 * | 10/2006 | Hoffman | E05C 3/042 70/127 |
| 2011/0147546 | A1 | 6/2011 | Monsalve et al. | |
| 2012/0006767 | A1 | 1/2012 | Bennett et al. | |
| 2012/0175476 | A1 | 7/2012 | Lau et al. | |
| 2018/0148958 | A1 * | 5/2018 | Liu | E05B 17/0025 |
| 2019/0063112 | A1 * | 2/2019 | Carabalona | E05C 3/042 |

FOREIGN PATENT DOCUMENTS

| | | | |
|---|---|---|---|
| JP | 1193468 | A | 4/1999 |
| JP | 2009533703 | A | 9/2009 |
| KR | 100825931 | B1 | 4/2008 |
| KR | 20100007683 | A | 1/2010 |
| WO | 2017011443 | A1 | 1/2017 |

OTHER PUBLICATIONS

International Preliminary Report on Patentability for International Application No. PCT/US2017/057076 dated Apr. 30, 2019, 10 Pages.
Japanese Notice of Reasons for Rejection for Japanese Application No. 2018-546876, dated Mar. 2, 2021 with translation, 7 pages.
Indian Examination Report for Indian Application No. 201917016534, dated Mar. 24, 2021 with translation, 7 pages.
European Communication pursuant to Article 94(3) for European Application No. 17794826.2, dated Mar. 11, 2021, 5 pages.
Notification of Reason for Refusal for Korean Application No. 10-2018-7028934, dated Apr. 16, 2021, with translation, 20 pages.
Partial European Search Report for European Application No. 21 164 667.4, dated Jun. 11, 2021, 11 pages.
Notice of Allowance for U.S. Appl. No. 16/082,332, dated Jul. 26, 2021, 66 pages.

* cited by examiner

SECTION P–P

COMPRESSION LATCH WITH KEY HOLDING

CROSS-REFERENCE TO RELATED APPLICATIONS

This application is a U.S. National Phase Application of PCT International Application PCT/US2017/057076, filed Oct. 18, 2017, and claims the benefit of priority of, U.S. Provisional Application No. 62/413,080, entitled COMPRESSION LATCH WITH KEY HOLDING, filed on 26 Oct. 2016, the contents of which are incorporated herein by reference in their entirety for all purposes.

FIELD OF THE INVENTION

The present invention relates generally to latches, and particularly, to compression latches that can be used for securing storage compartments and can provide for holding a key during opening and closing.

BACKGROUND OF THE INVENTION

Conventionally, storage compartments in restricted areas (such as train baggage for example) must be secured to prevent unauthorized access to their contents. Latches may be used to restrict access to such compartments to users having a corresponding key. In many latches, it may not be clearly visible to the user whether the latch is in an opened or closed position. For such latches, it may be advantageous that during an opening or closing operation, the key is held by the latch until the opening or closing operation is complete.

SUMMARY OF THE INVENTION

Aspects of the present invention are related to latches.

In accordance with one aspect, a latch is configured to fix a panel relative to a frame. The latch includes a housing, a cap, a bushing, and a ball. The housing is configured for engagement to the panel. The housing has a longitudinal axis and defines an aperture along the longitudinal axis. The aperture includes a cutout area. The cap is mounted within the aperture of the housing for rotation about the longitudinal axis. The cap comprises an outer surface including a drive projection and a cutout area. The bushing is mounted within the aperture of the housing for rotation about the longitudinal axis. The bushing comprises an upper surface and a sidewall. The sidewall is positioned between the cap and the housing. The sidewall defines a drive surface positioned to contact the drive projection of the cap and an opening. The ball is positioned within the opening of the bushing. The ball is configured to be positioned at least partially within the cutout area of the housing or the cutout area of the cap.

In accordance with another aspect, a latch is configured for movement by a driver between a latched condition to fix a panel relative to a frame and an unlatched condition. The latch includes a housing, a cap, and a bushing. The housing is configured for engagement to the panel. The housing has a longitudinal axis and defines an aperture along the longitudinal axis. The cap is mounted to extend within the aperture of the housing for rotation relative to the housing about the longitudinal axis. The cap has a cap drive surface positioned for contact by the driver. The bushing is mounted to extend within the aperture of the housing for rotation relative to the housing about the longitudinal axis. The bushing defines a window positioned to receive the driver. The cap and the bushing are configured such that an alignment of the cap drive surface of the cap and the window of the bushing permits insertion or withdrawal of the driver from the cap drive surface of the cap through the window of the bushing when the latch is in the latched condition, and a misalignment of the cap drive surface of the cap and the window of the bushing blocks insertion or withdrawal of the driver from the cap drive surface of the cap through the window of the bushing when the latch is not in the latched condition.

BRIEF DESCRIPTION OF THE DRAWINGS

The invention is best understood from the following detailed description when read in connection with the accompanying drawings. It is emphasized that, according to common practice, the various features of the drawings are not to scale. On the contrary, the dimensions of the various features may be arbitrarily expanded or reduced for clarity. Included in the drawings are the following figures.

DETAILED DESCRIPTION OF THE INVENTION

Figure 1A:
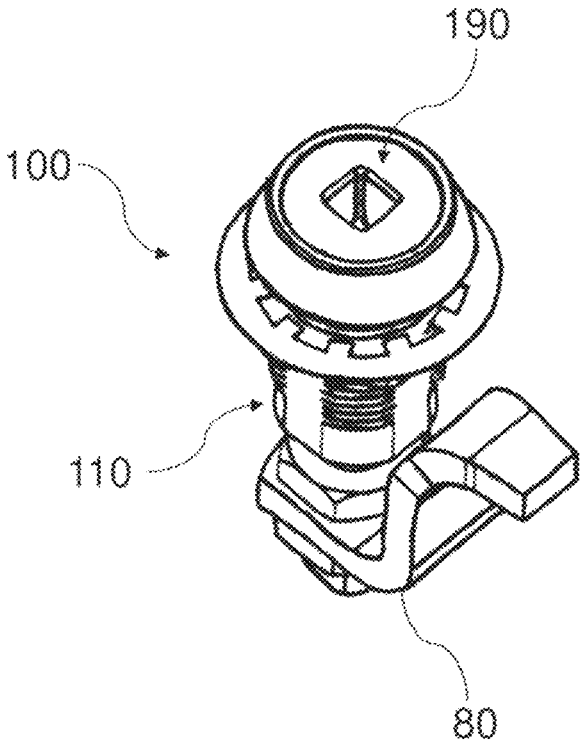
FIG. 1A depicts an exemplary latch configured to fix a panel relative to a frame in accordance with aspects of the present invention.

Although the invention is illustrated and described herein with reference to specific embodiments, the invention is not intended to be limited to the details shown. Rather, various modifications may be made in the details within the scope and range of equivalents of the claims and without departing from the invention.

The exemplary latches described herein may have a lower profile than conventional latches for storage compartments in that they can provide for a reduction of the degree of the protrusion of the latch into such compartments, decreasing or eliminating the effect of the latch on available storage space. These embodiments generally incorporate a latch cap and shaft which rotatably and axially move to open or close the compartment.

The exemplary latches described herein may also be capable of holding a key (or driver) within the latch during an opening and/or closing operation until the opening and/or closing operation is complete. This feature may be helpful to prevent accidental or unintentional removal of the key before the latch is completely opened or closed. Additionally, the presence of a key retained with a latch may be usable to provide an indication that a latch is not in a fully closed or latched state.

In examples set forth below, the key is retained in the latch whenever the latch is not latched. Retaining the key in the latch may serve as a reminder to latch compartments, and may promote a methodical opening and closing sequence by retaining the key. During the latch opening sequence, the cap of the latch rotates a predetermined amount (e.g., 15, 30, 45, 60, 75, 90 degrees, etc.) relative to an exterior bushing, and remains in this position throughout the opening process while allowing normal opening rotation and compression release functions of the latch. As a result, when in the unlatched position, it is not possible to remove the key. The sequence is reversed in the latching operation, allowing the key to released only when the cap and bushing have returned to the latched position.

While particular latch embodiments are described herein, components of the disclosed embodiments may be incorporated into any conventional latches known to one of ordinary skill in the art to achieve the advantages described herein. For example, components of the disclosed embodiments may be incorporated into those latches described in PCT International Application No. PCT/US2016/041873, the contents of which are incorporated herein by reference in their entirety. Likewise, the disclosed latches may be usable on any structure, including any type of storage compartments in which it is desirable to secure the contents of the compartment. The latch is preferably a compression latch for use with a panel mounted to a frame. Such a compression latch is configured for movement from an open position in which a panel is not latched relative to the frame, to a latched position in which the panel is latched relative to the frame, and to a latched position in which the panel is pulled against the frame such that they are compressed against one another.

Figure 1B:
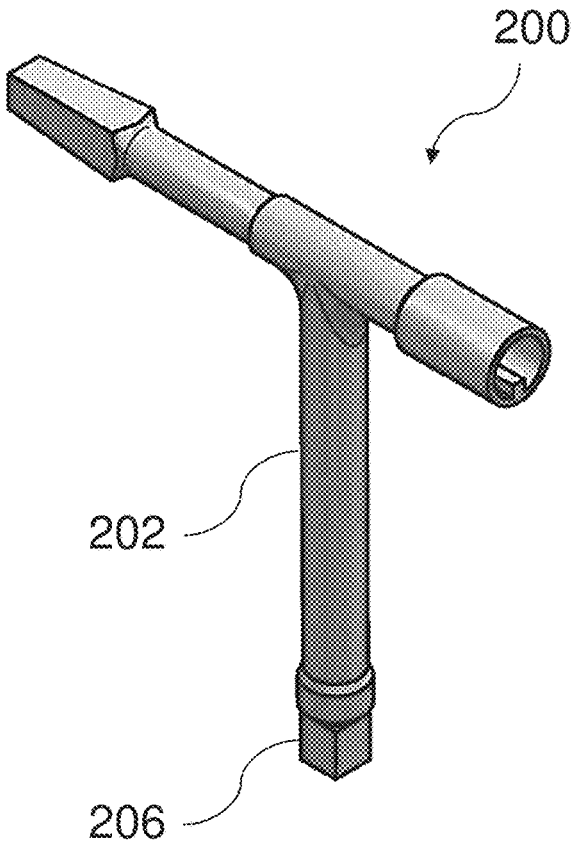
FIGS. 1B and 1C depict an exemplary key for the latch of FIG. 1A.
Figure 1C:
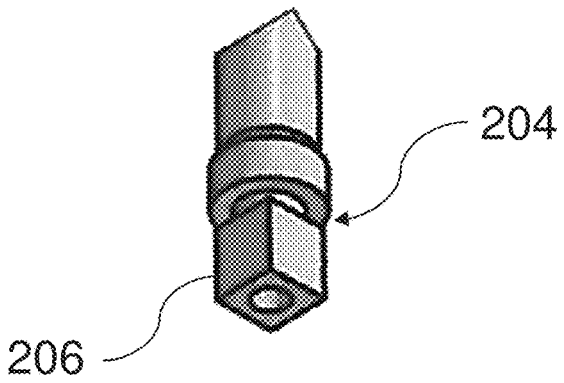
Figure 2:
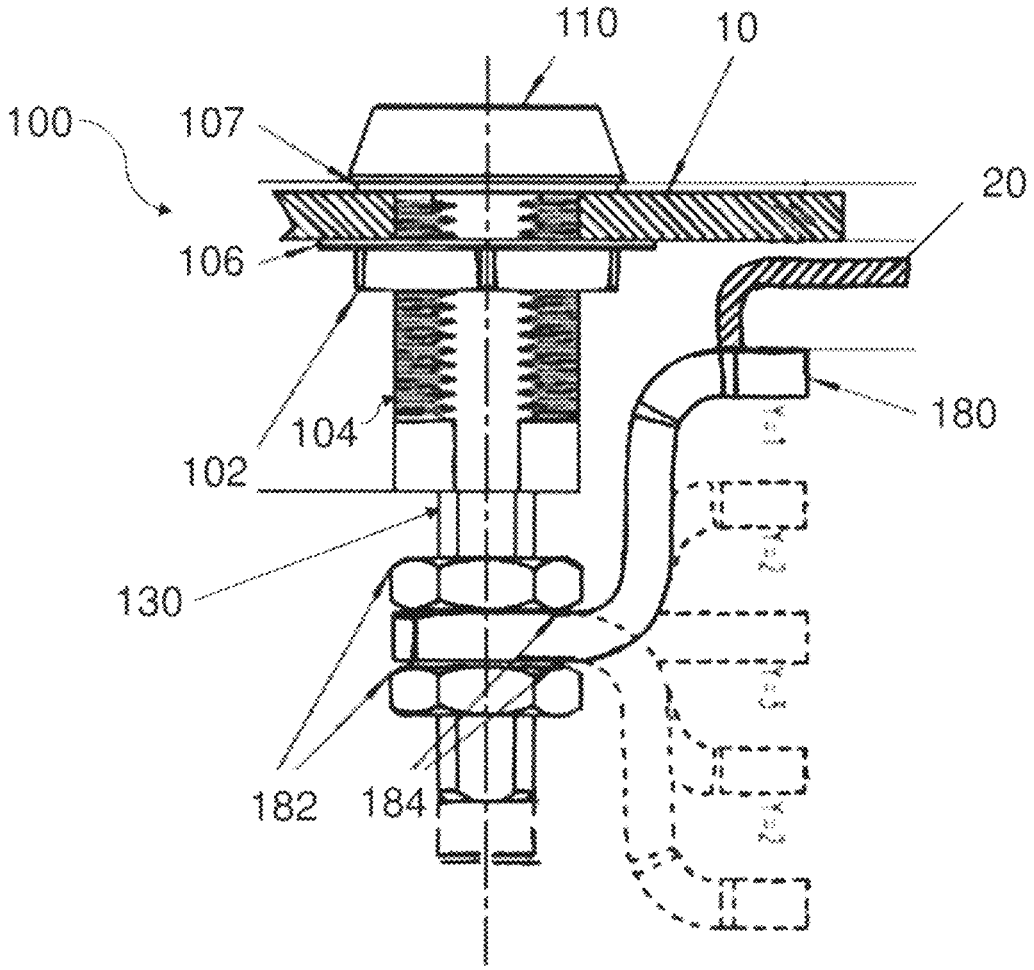
FIG. 2 depicts the latch of FIG. 1A fixing a panel relative to a frame.
Figure 3:
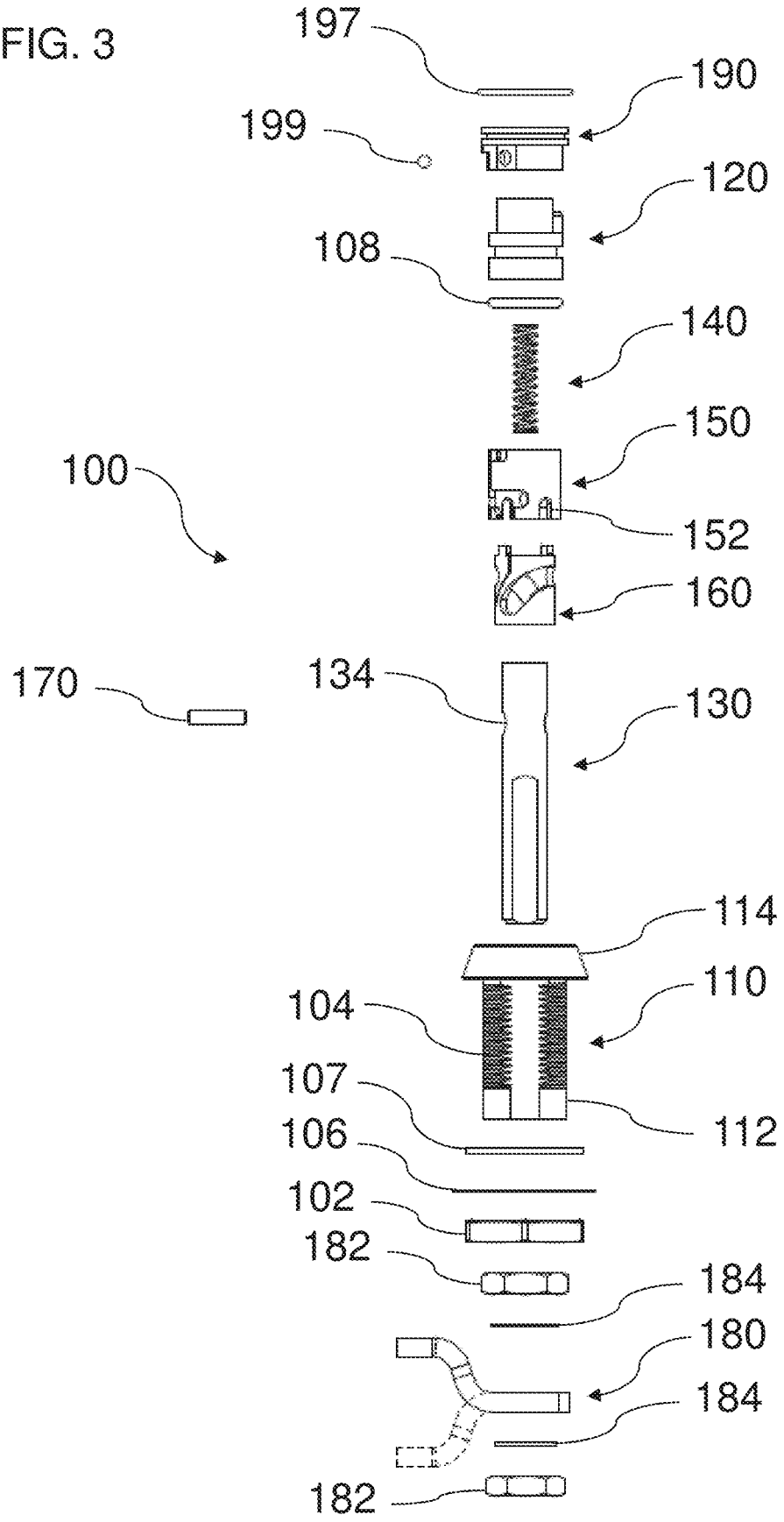
FIG. 3 depicts an exploded view of components of the latch of FIG. 1A.

Referring now to the drawings, FIGS. 1A-9C illustrate an exemplary latch 100 in accordance with aspects of the present invention. Latch 100 is configured to fix a panel 10 relative to a frame 20, as shown in FIG. 2. As a general overview, latch 100 includes a housing 110, a cap 120, a bushing 190, a ball 199, a shaft 130, a spring 140, a sleeve 150, a cam 160, pin 170, and a pawl 180. Additional details of latch 100 are described below.

Figure 4A:
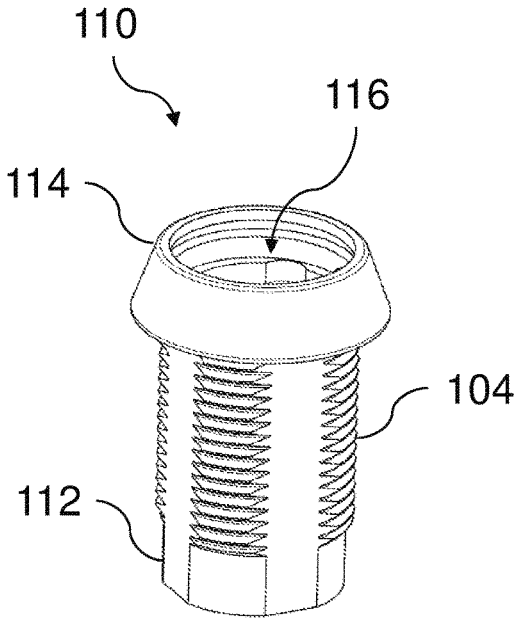
FIGS. 4A-4D depict an exemplary housing of the latch of FIG. 1A.
Figure 4B:
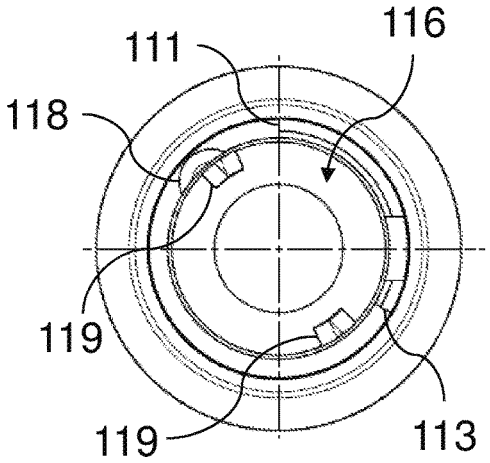
Figure 4C:
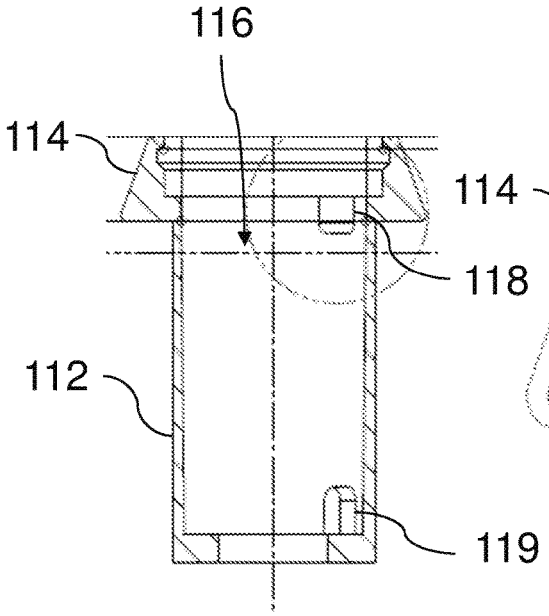
Figure 4D:
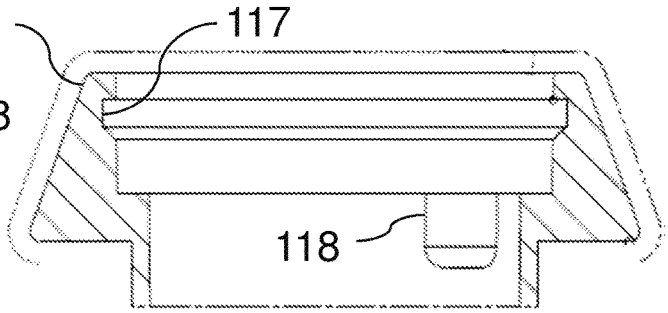

Housing 110 houses the components of latch 100. FIG. 4A shows a perspective view of housing 110; FIG. 4B shows a top view of housing 110; FIGS. 4C and 4D show cross-sectional side views of housing 110.

Housing 110 is configured for engagement to panel 10. In an exemplary embodiment, as shown in FIGS. 4A-4D, housing 110 has a body portion 112 sized to fit within a through-hole in panel 10. Housing 110 further includes a flanged portion 114 extending circumferentially around an outer surface of body portion 112. Flanged portion 114 is sized to contact an inner or outer surface of panel 10 when body portion 112 of housing 110 is received within the through-hole.

In a preferred embodiment, housing 110 engages with panel 10 using a nut 102. Nut 102 is adapted to be screwed onto threading 104 formed on the outer surface of body portion 112, such that panel 10 is clamped between flanged portion 114 and nut 102. A washer 106 may be added between panel 10 and nut 102 to create an appropriate securement of latch 100 to panel 10. Additionally, a gasket 107 may be added between panel 10 and the flanged portion 114 of the housing 110 to secure the interior of the compartment from external elements such as liquid or dust. The use of nut 102 within the compartment to secure latch 100 to panel 10 desirably prevents unauthorized removal of latch 100 from panel 10.

Alternatively or additionally, housing 110 may engage with panel 10 by any other means, including for example a frictional or threaded fit of body portion 112 within the through-hole of panel 10, or adhering the flanged portion 114 to the surface of panel 10. For example, a fastener such as a screw and bracket can be used in certain mounting configurations. Still further, a portion or all of housing 110 may be formed as an integral or unitary piece with panel 10.

Body portion 112 of housing 110 extends along a longitudinal axis. As shown in FIG. 2, the longitudinal axis generally extends in a direction orthogonal to the plane of panel 10. Nonetheless, it will be understood from the description herein that the longitudinal axis may extend at an oblique angle relative to panel 10, and the direction of the longitudinal axis is not intended to be limited.

Body portion 112 of housing 110 further defines an aperture 116 therein which extends along the longitudinal axis. Aperture 116 is sized to accommodate the components of latch 100, as described below. Aperture 116 further includes a cutout area 118, as shown in FIG. 4B. Cutout area 118 is provided in the inner sidewall of body portion 112. Cutout area 118 provides a space for receiving ball 199, as will be described in greater detail below.

Housing 110 may further include stop surfaces 111 and 113. Stop surfaces 111 and 113 are formed by sections of the body portion 112 protruding inward into aperture 116, as shown in FIG. 4B. Stop surface 111 is positioned to block a clockwise rotation of bushing 190, and stop surface 113 is positioned to block a counterclockwise rotation of bushing 190.

Figure 5A:
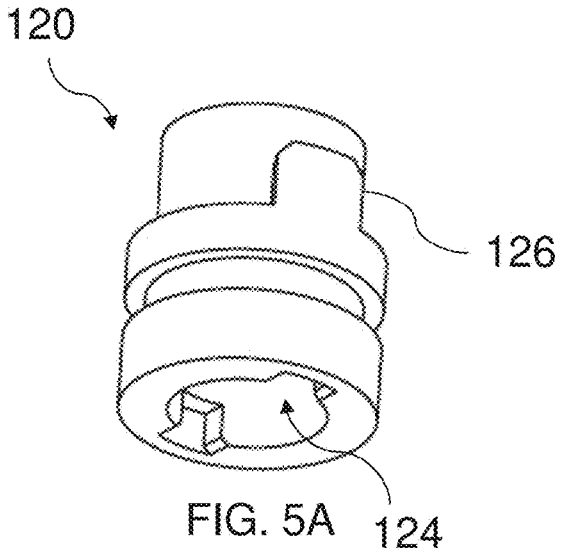
FIGS. 5A-5F depict an exemplary cap of the latch of FIG. 1A.
Figure 5B:
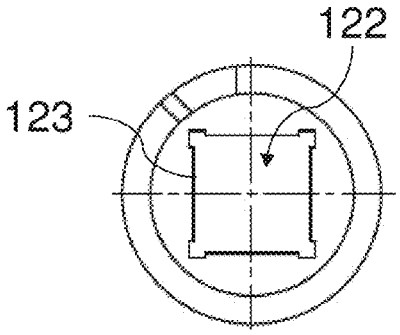
Figure 5C:
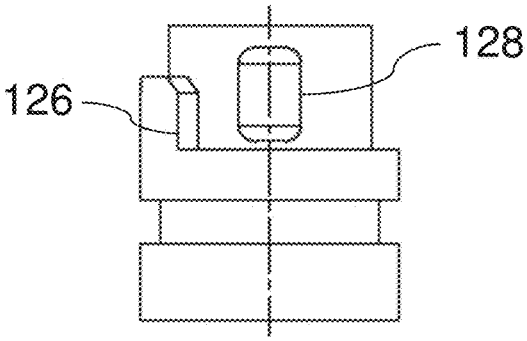
Figure 5D:
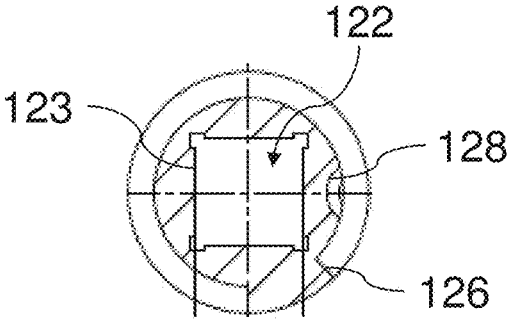
Figure 5E:
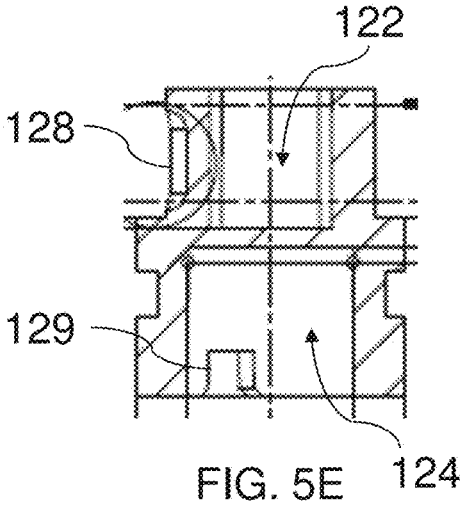
Figure 5F:
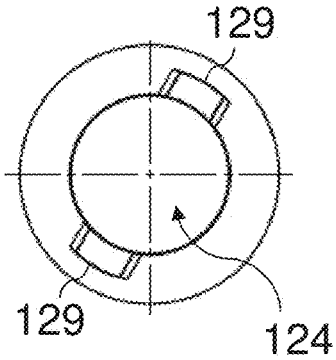

Cap 120 is mounted within aperture 116 of housing 110. FIG. 5A shows a perspective view of cap 120; FIG. 5B shows a top view of cap 120; FIG. 5C shows a side view of cap 120; FIG. 5D shows a cross-sectional top view of cap 120; FIG. 5E shows a cross-sectional side view of cap 120; FIG. 5F shows a bottom view of cap 120.

Cap 120 is not affixed to housing 110, so that it can rotate relative to housing 110 around the longitudinal axis. Cap 120 includes at least one drive opening 122 at its upper end, as shown in FIG. 5B. Drive opening 122 extends along the longitudinal axis and forms a drive surface 123 for rotating cap 120. Drive surface 123 is accessible when cap 120 is mounted within housing 110, in order to enable a user to drive or rotate cap 120, e.g., with a key. Drive opening 122 may be formed with a shape corresponding to a shape of the key. In this form, cap 120 cannot readily be rotated relative to housing 110 without the corresponding key for engaging with drive surface 123.

Cap 120 further includes at least one longitudinally extending recess 124. Recess 124 is formed in a lower surface of cap 120, opposite drive surface 123. Recess 124 is formed to mate with a portion of shaft 130, as described below.

The outer surface of cap 120 includes a drive projection 126 and a cutout area 128. Drive projection 126 provides a surface for driving rotation of bushing 190. Cutout area 128 provides a space for receiving ball 199. The function of these structures will be described in greater detail below.

Figure 9A:
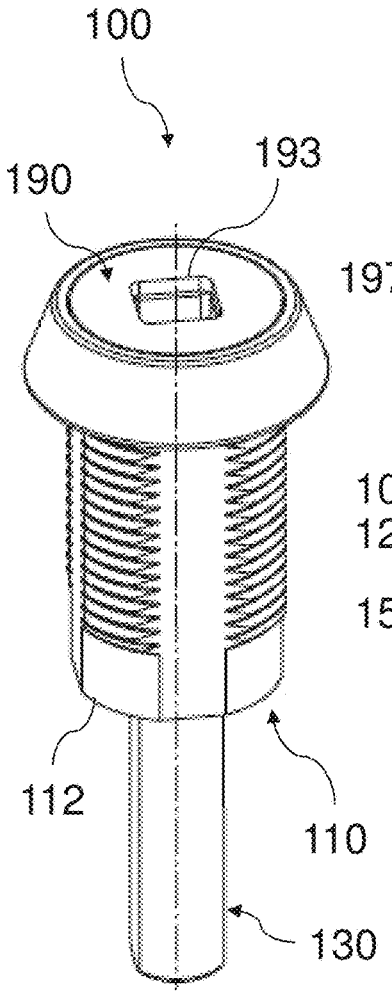
FIG. 9A depicts the latch of FIG. 1A without a pawl or associated components.
Figure 9B:
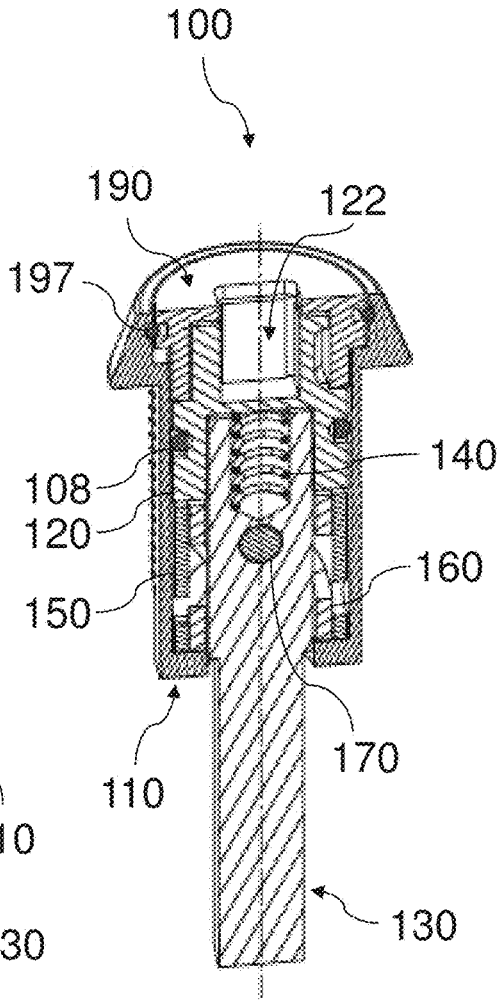
FIGS. 9B and 9C depict cross-sectional views of the latch of FIG. 9A.
Figure 9C:
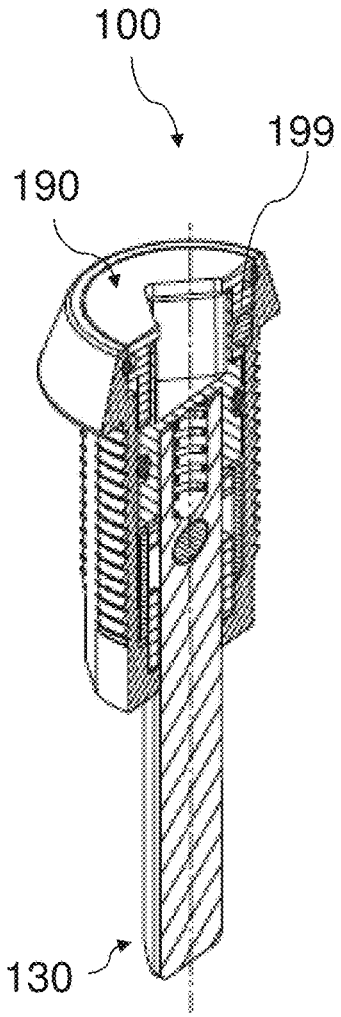

In a preferred embodiment, as shown in FIG. 9B, a gasket 108 such as an O-ring may be added between housing 110 and cap 120 in order to secure the interior of body portion 112 from external elements such as liquid or dust. Cap 120 and/or housing 110 may include an annular groove or surface for accommodating gasket 108 between cap 120 and housing 110.

Figure 6A:
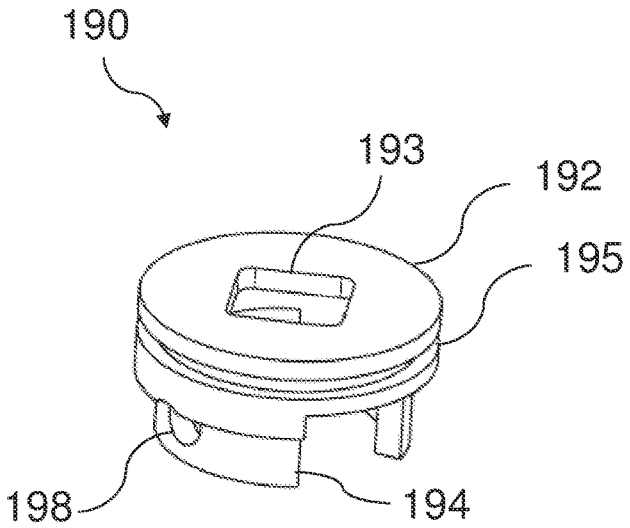
FIGS. 6A-6D depict an exemplary bushing of the latch of FIG. 1A.
Figure 6B:
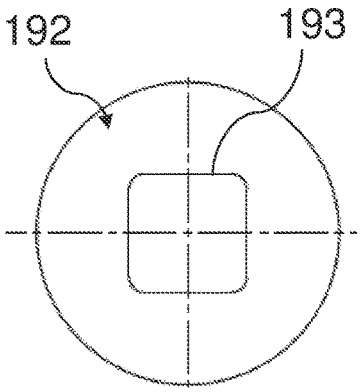
Figure 6C:
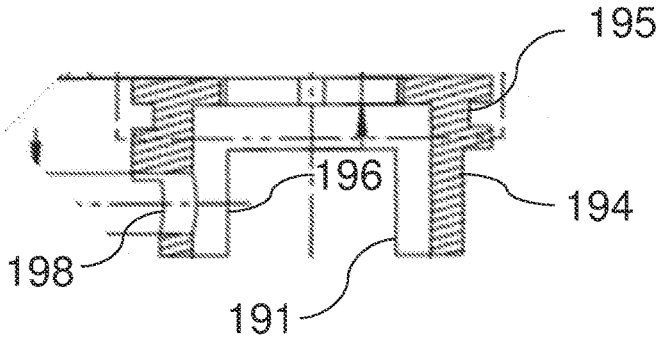
Figure 6D:
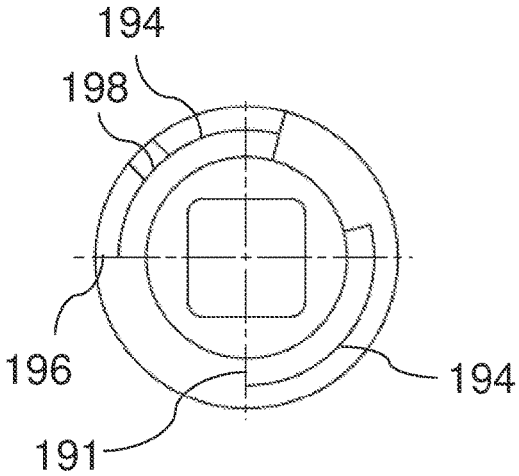

Bushing 190 is mounted within aperture 116 of housing 110. FIG. 6A shows a perspective view of bushing 190; FIG. 6B shows a top view of bushing 190; FIG. 6C shows a cross-sectional side view of bushing 190; and FIG. 6D shows a bottom view of bushing 190.

Like cap 120, bushing 190 is not affixed to housing 110, so that it can rotate relative to housing 110 around the longitudinal axis. Bushing 190 includes an upper surface 192 and a cylindrical sidewall 194 extending downward from upper surface 192. As shown in FIGS. 6A and 6B, bushing 190 includes a window 193 in its upper surface 192. Window 193 overlaps with the drive opening 122 of cap 120. Thus, window 193 provides access to the drive opening 122 and drive surface 123 of cap 120, in order to enable opening or closing of latch 100.

Sidewall 194 is positioned between housing 110 and cap 120. Sidewall 194 includes a drive surface 196 and an opening 198. Drive surface 196 and opening 198 are separated from one another by the same circumferential distance as the circumferential distance between drive projection 126 and cutout area 128. Drive surface 196 provides a surface for contacting and being driven by drive projection 126 of cap 120. Opening 198 provides a space for receiving ball 199. The function of these structures will be described in greater detail below.

Bushing 190 may further include a stop surface 191. Stop surface 191 is formed by a section of sidewall 194 facing cap 120, as shown in FIG. 6D. Stop surface 191 is positioned to block a clockwise rotation of cap 120.

Bushing 190 may be prevented from axial movement relative to housing 110. In an exemplary embodiment, housing 110 includes an annular groove 117 and bushing 190 includes an annular groove 195. A retaining ring 197 is positioned within annular grooves 117 and 195. When retaining ring 197 is seated within grooves 117 and 195, it prevents axial movement of bushing 190 out of the aperture 116 defined by body portion 112. Retaining ring 197 may be formed as a complete ring or as a split ring.

Ball 199 is positioned within opening 198 of bushing 190, Ball is unaffixed to housing 110, cap 120, or bushing 190, so that ball is capable of moving (e.g. rolling) within latch 100. However, the movement of ball 199 is limited by the surfaces of housing 110, cap 120, and/or bushing 190. In an exemplary embodiment, ball 199 is always positioned within opening 198 of bushing 190, and is also positioned at least partially within either cutout area 118 of housing 110, or cutout area 128 of cap 120.

Figure 7A:
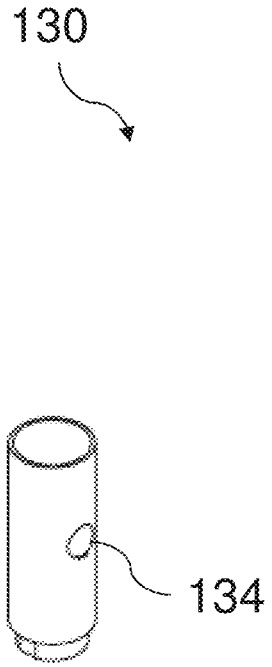
FIGS. 7A-7E depict an exemplary shaft of the latch of FIG. 1A.
Figure 7B:
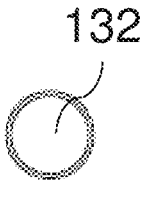
Figure 7C:
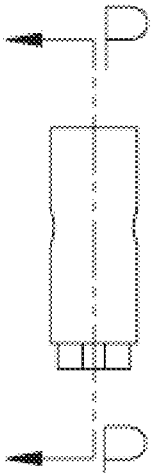
Figure 7D:
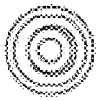
Figure 7E:
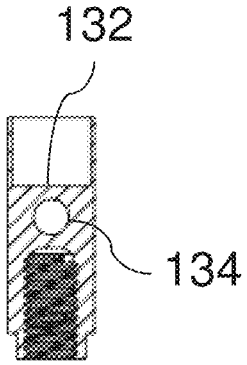

Shaft 130 is mounted at least partially within aperture 116 of housing 110. FIG. 7A shows a perspective view of shaft 130; FIG. 7B shows a top view of shaft 130; FIG. 7C shows a side view of shaft 130; FIG. 7D shows a bottom view of shaft 130; and FIG. 7E shows a cross-sectional side view of shaft 130.

Shaft 130 extends along the longitudinal axis of housing 110. Shaft 130 is mounted to be rotatable around the longitudinal axis relative to housing 110 and cap 120. As shown in FIGS. 7B and 7D, shaft 130 may have a circular shape in order to enable unobstructed rotation of shaft 130 within housing 110.

Shaft 130 is mounted to be axially movable relative to housing 110 and cap 120. Shaft 130 includes a through-hole 134 which extends in the radial direction through the body of shaft 130. Through-hole 134 is shaped to accommodate a pin 170 passing through shaft 130, as described in further detail below.

Spring 140 is configured to bias shaft 130 away from cap 120 along the longitudinal axis. In an exemplary embodiment, spring 140 is a compression spring positioned between an underside of cap 120 and a surface 132 of shaft 130. The spring can include one or multiple elements, such as compression springs, wave springs, belleville washers, elastomeric springs, and/or conical springs. In an exemplary embodiment, the upper end of spring 140 is provided in a recess on the underside of cap 120, and the lower end of spring 140 is provided in a recess within shaft 130, in order to reduce or further reduce the overall height of cap 120.

Sleeve 150 is positioned within aperture 116 interposed between housing 110 and shaft 130. Sleeve 150 thus defines an aperture in which shaft 130 is positioned.

Figure 8B:
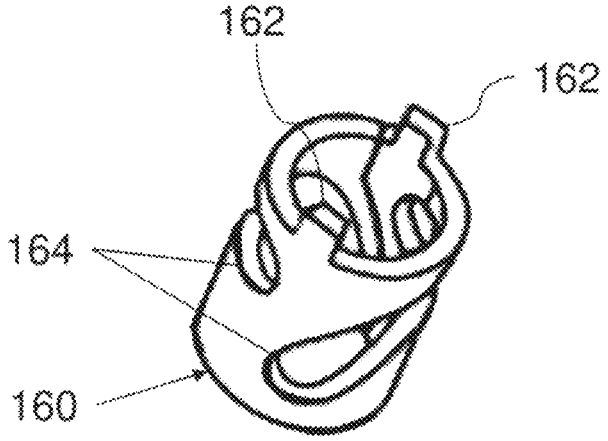
FIGS. 8A and 8B depict an exemplary cam and an exemplary sleeve, respectively, of the latch of FIG. 1A.
Figure 8A:
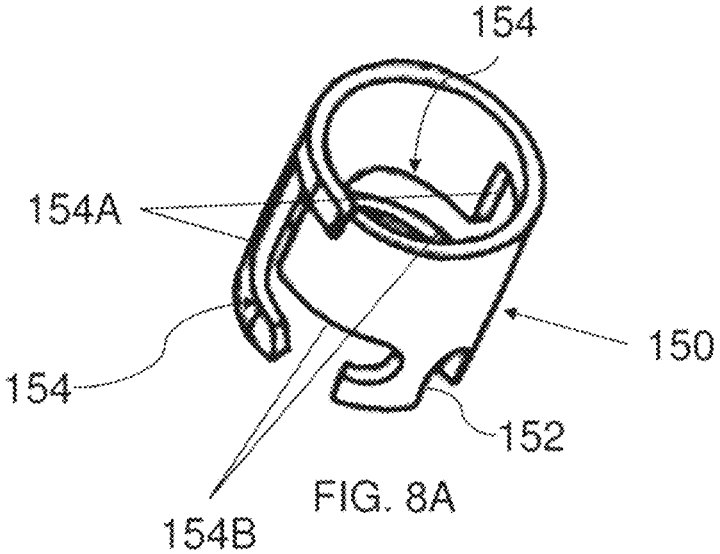

Sleeve 150 is mounted within housing 110 in such a manner to prevent rotation of sleeve 150 relative to housing 110. In an exemplary embodiment, as shown in FIG. 8A, sleeve 150 includes one or more keying features 152 positioned to mate with keying features 119 in housing 110. Keying features 152 and 119 may be detents, projections, recesses, or any other anti-rotation structures known to one of ordinary skill in the art from the description herein. Alternatively, all or a portion of sleeve 150 may be formed integrally or as a unitary piece with housing 110.

Sleeve 150 defines a pair of slots 154. Slots 154 are sized to receive pin 170 therein, and to allow axial and/or circumferential movement of pin 170 along each slot 154. In an exemplary embodiment, each slot 154 has an L-shape, with a first portion 154A extending in the longitudinal or axial direction of housing 110, and a second portion 1546 extending in the circumferential direction of housing 110. The first and second portions 154A, 1546 of each slot 154 guide the movement of shaft 130 within housing 110 during an opening or closing operation of latch 100, as described in greater detail below.

Cam 160 is positioned within sleeve 150 interposed between sleeve 150 and shaft 130. Cam 160 is mounted within sleeve 150 to be rotatable relative sleeve 150 around the longitudinal axis. In particular, cam 160 is mounted to be rotatable with cap 120. In an exemplary embodiment, as shown in FIG. 86, cam 160 includes one or more keying features 162 positioned to mate with keying features 129 in the lower surface of cap 120. Keying features 162 and 129 may be detents, projections, recesses, or any other anti-rotation structures known to one of ordinary skill in the art from the description herein.

Cam 160 defines a pair of slots 164. Slots 164 are sized to receive pin 170 therein, and to allow axial and/or circumferential movement of pin 170 along each slot 164. In an exemplary embodiment, each slot 164 is spirally curved around the outer circumferential surface of cam 160 between a first position near cap 120 and a second position axially spaced from the first position away from cap 120. With slots 154, slots 164 guide the movement of shaft 130 within housing 110 during an opening or closing operation of latch 100, as described in greater detail below.

While cam 160 is described as being a separate component from cap 120, it will be understood that the invention is not so limited. Alternatively, all or a portion of cam 160 could be formed integrally or as a unitary piece with cap 120. Such a structure may be desired in order to further minimize the overall protrusion of latch 100.

Additionally, while cam 160 is described as being positioned within sleeve 150, it will be understood that the invention is not so limited. Cam 160 could alternatively be positioned outside of sleeve 150, such that sleeve 150 is interposed between cam 160 and shaft 130, without departing from the scope of the invention. In such an embodiment, sleeve 150 may be keyed to or integrally formed with cap 120, and cam 160 may be keyed to or integrally formed with housing 110, without departing from the scope of the invention.

Pin 170 extends radially outward from shaft 130 relative to the longitudinal or axial direction of housing 110. Pin 170 is captured within an aperture formed in the shaft 130, and is received with slots 154 and 164. As a result, shaft 130 is limited to moving rotationally or axially within the path defined by the engagement of pin 170 with slots 154 and 164.

In an exemplary embodiment, pin 170 is a cylindrical post extending diametrically through through-hole 134 of shaft 130. The post has a length sufficient to form diametrically opposed pins on either side of shaft 130. In this embodiment, sleeve 150 and cam 160 may each include a pair of diametrically opposed slots 154 and 164 on either side thereof. Accordingly, while the operation of latch 100 is described herein with respect to a single slot 154, 164 and pin 170, it will be understood by one of ordinary skill in the art that one, two, or more respective slots and pins may be used without departing from the scope of the invention.

Pawl 180 is coupled to shaft 130. In an exemplary embodiment, pawl 180 is fixedly coupled to the lower end of shaft 130 with a pair of nuts 182. Washers 184 may be added between nuts 182 and pawl 180 to create an appropriate securement of pawl 180 to shaft 130.

Pawl 180 is movable between a closed position and an open position. Pawl 180 is moved between the closed position and the open positioned by rotation and axial movement of shaft 130. In the closed position, shown in FIG. 2, pawl 180 engages frame 20 and fixes panel 10 relative to frame 20. As shown in dashed lines in FIG. 2, pawl 180 may extend at a different angle away from shaft 130 depending on the thickness of frame 20. In the open position, pawl 180 disengages from frame 20, and allows relative movement of panel 10 relative to frame 20.

Latch 100 is opened or closed using a key 200. As shown in FIGS. 1B and 1C, key 200 includes a shaft 202, a groove 204, and an end 206. End 206 is shaped to mate with the drive opening 122 of cap 120. Groove 204 is provided above end 206 and is narrower than end 206, to allow holding of key 200 within latch 100 during an opening or closing operation, as will be discussed in greater detail below. Suitable keys for use as key 200 will be known to those of ordinary skill in the art from the description herein.

An exemplary operation of latch 100 is described below with respect to FIGS. 10A-15C, In these drawings, panel 10 and frame 20 are not shown in order to better illustrate the function of the components of latch 100. While the exemplary operation depicts a counterclockwise rotation of the cap, it will be understood that the operations described herein may alternatively be performed with a clockwise rotation of the cap.

Figure 10A:
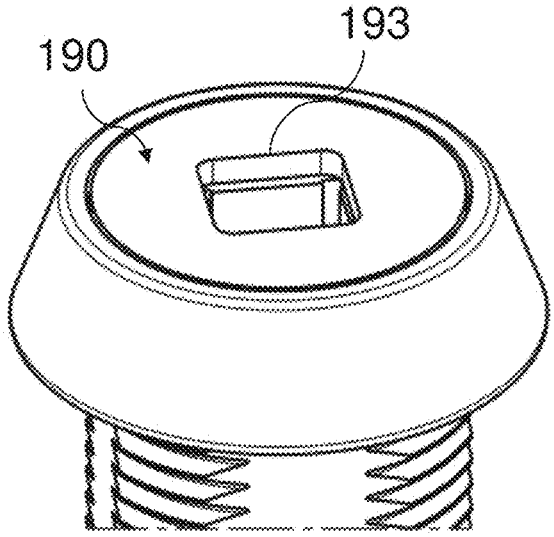
FIGS. 10A-10C depict a first step of an exemplary opening operation of the latch of FIG. 1A.
Figure 10B:
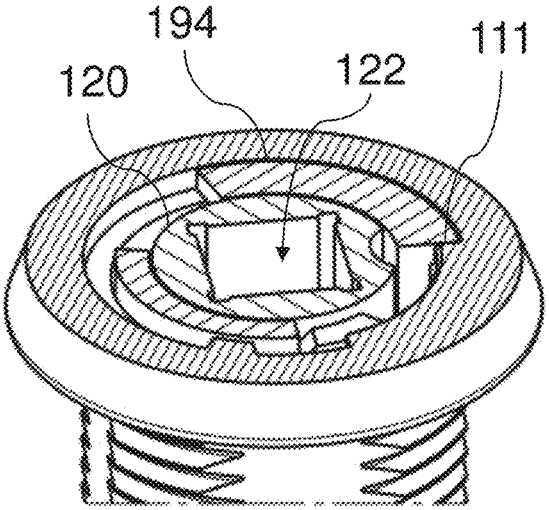
Figure 10C:
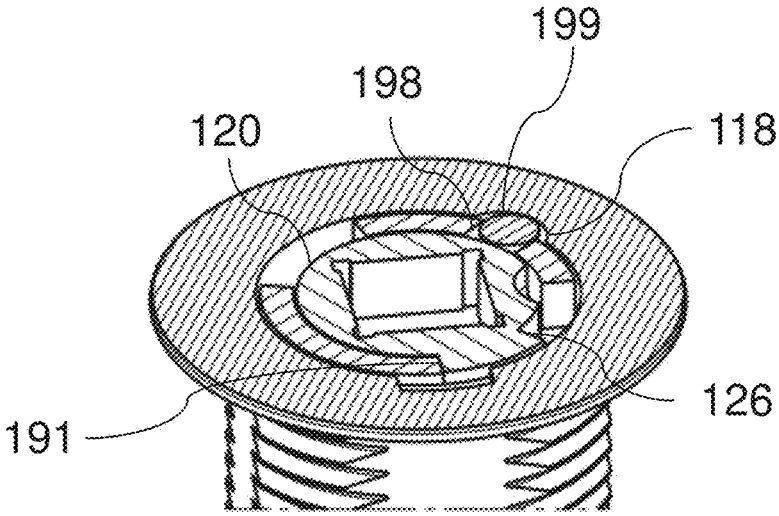

FIGS. 10A-10C show latch 100 in the closed position. As shown in FIGS. 10A and 10B, window 193 of bushing 190 is aligned with drive opening 122 of cap 120, allowing insertion of end 206 of key 200 into drive opening 122. As shown in FIG. 10B, bushing 190 is positioned against stop surface 111 of housing 110, to prevent rotation of bushing 190 in a clockwise direction. Likewise, as shown in FIG. 10C, cap 120 is positioned against stop surface 191, to prevent rotation of cap 120 in a clockwise direction. Finally, ball 199 is positioned in opening 198 and at least partially positioned within cutout area 118 of housing 110. Ball 199 is prevented from moving out of cutout area 118 by the outer surface of cap 120. Accordingly, ball 199 locks the position of bushing 190 relative to housing 110.

At this stage, in order to open latch 100, a user inserts a key 200 through window 193 and into drive opening 122, and begins rotating in a counterclockwise direction. Rotating cap 120 allows cap 120 to move relative to bushing 190 and housing 110, without movement of bushing 190. Rotating cap 120 also causes a corresponding rotation of cam 160, e.g., due to keying features 162 and 129. As cam 160 rotates, the spiral slot 164 of cam 160 applies a force to pin 170 in an axial and circumferential direction. The first portion of the L-shaped slot 154 allows movement of pin 170 in the axial direction, and prevents movement of pin 170 in the circumferential direction. As a result, rotation of cap 120 and cam 160 from the closed position causes pin 170, and correspondingly shaft 130, to move only in the axial direction away from cap 120 (under bias from spring 140). This axial movement of shaft 130 moves pawl 180 axially downward and away from frame 20. The axial movement of pin 170 proceeds until pin 170 reaches the second portion of L-shaped slot 154.

Figure 11A:
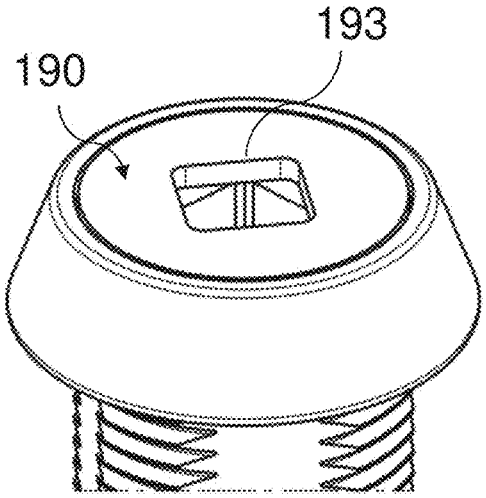
FIGS. 11A-11C depict a second step of the opening operation of FIGS. 10A-10C.
Figure 11B:
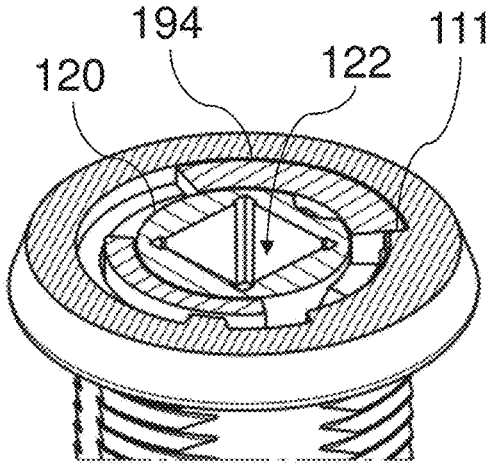
Figure 11C:
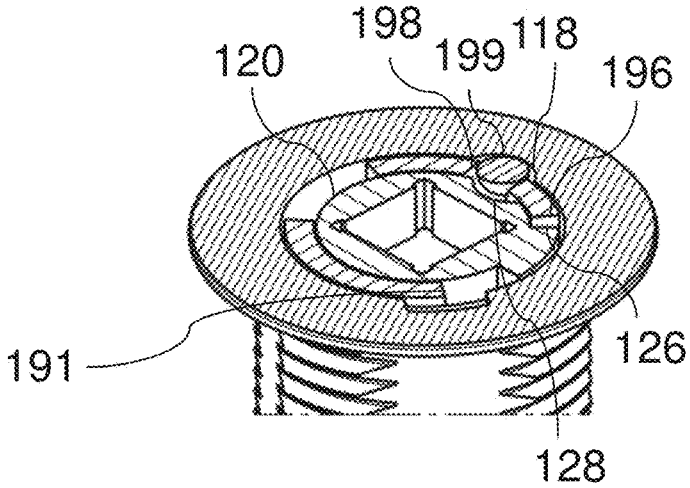

FIGS. 11A-11C show latch 100 in a first intermediate position between the opened and closed positions, before drive projection 126 of cap 120 contacts drive surface 196 of bushing 190. In this position, cap 120 has been rotated approximately 35° from the closed position, and bushing 190 has not been rotated. As shown in FIG. 118, bushing 190 is still positioned against stop surface 111 of housing 110, and ball 199 is still positioned in opening 198 and at least partially within cutout area 118 of housing 110. However, as shown in FIG. 11C, cap 120 is rotated away from stop surface 191, Due to this rotation, drive opening 122 of cap 120 is no longer aligned with window 193 of bushing 190. End 206 of key 200 remains positioned within drive opening 122, while the edges of window 193 are positioned with groove 204. The edges of window 193 thus block removal of key 200 from latch 100 while latch 100 is not in the closed position of FIGS. 10A-10C.

Figure 12A:
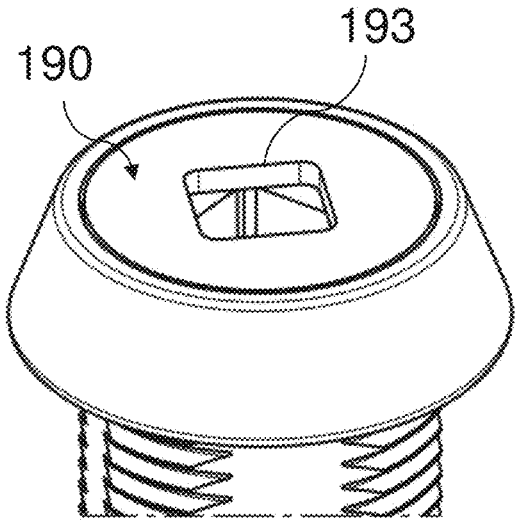
FIGS. 12A-12C depict a third step of the opening operation of FIGS. 10A-10C.
Figure 12B:
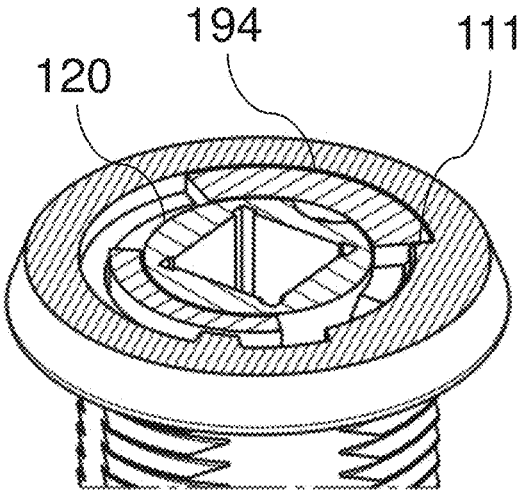
Figure 12C:
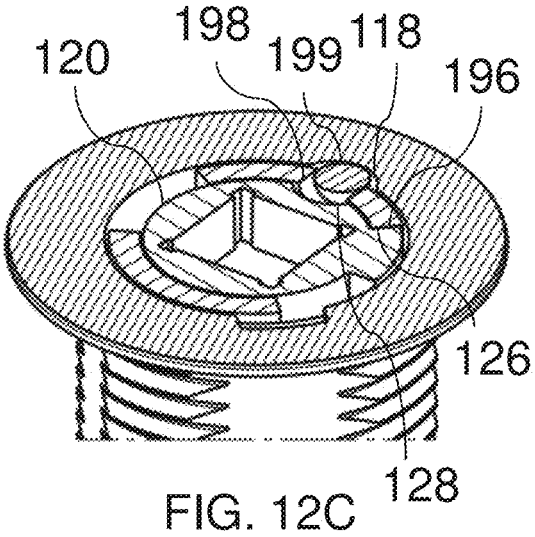

FIGS. 12A-12C show latch 100 in a second intermediate position between the opened and closed positions, as drive projection 126 of cap 120 contacts drive surface 196 of bushing 190. In this position, cap 120 has been rotated approximately 45° from the closed position, and bushing 190 has not been rotated. As shown in FIG. 12B, bushing 190 is still positioned against stop surface 111 of housing 110, and ball 199 is still positioned in opening 198 and at least partially within cutout area 118 of housing 110. However, ball 199 is no longer prevented from moving out of cutout area 118 by the outer surface of cap 120. Instead, as shown in FIG. 12C, cutout area 128 of cap 120 faces cutout area 118 of housing, and thus provides a space into which ball 199 can move. Thus, ball 199 no longer locks the position of bushing 190 relative to housing 110.

At this point, further rotation of cap 120 results in a corresponding rotation of bushing 190. The respective window 193 and drive opening 122 are thus locked at a 45° difference relative to one another over the remaining rotation of cap 120 and bushing 190. Accordingly, end 206 of key 200 is retained within latch 100 over the remaining rotation, preventing removal of key 200 until latch 100 is returned to the closed (e.g. latched) position.

Figure 13A:
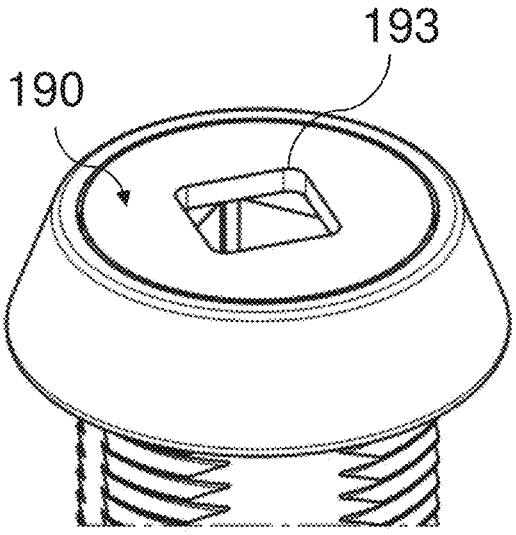
FIGS. 13A-13C depict a fourth step of the opening operation of FIGS. 10A-10C.
Figure 13B:
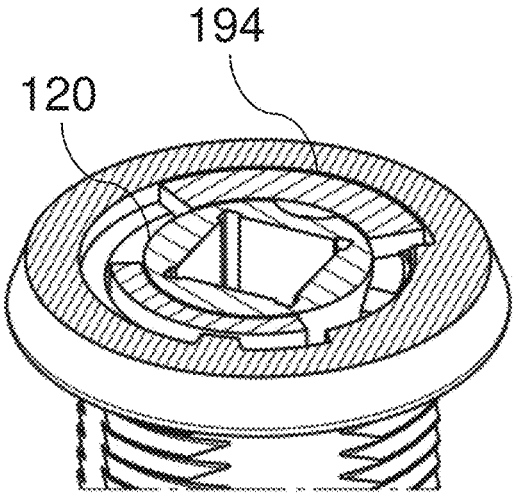
Figure 13C:
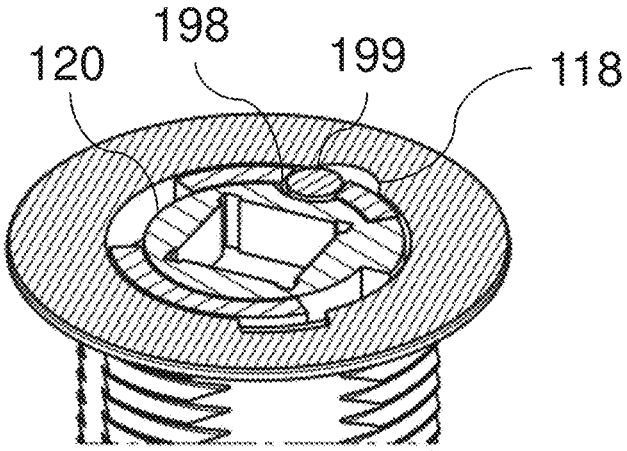

FIGS. 13A-13C show latch 100 in a third intermediate position between the opened and closed positions, as cap 120 begins to move bushing 190. In this position, cap 120 has been rotated approximately 55° from the closed position, and bushing 190 has been rotated approximately 10° from the closed position. As shown in FIG. 13B, bushing 190 is no longer positioned against stop surface 111 of housing 110. As shown in FIG. 13C, ball 199 is now positioned in opening 198 and at least partially within cutout area 128 of cap 120.

Figure 14A:
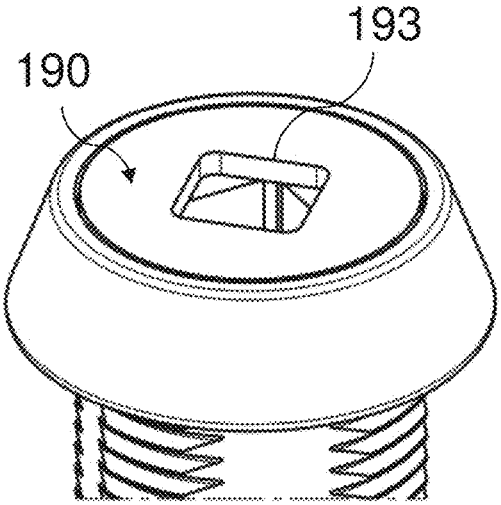
FIGS. 14A-14C depict a fifth step of the opening operation of FIGS. 10A-10C.
Figure 14B:
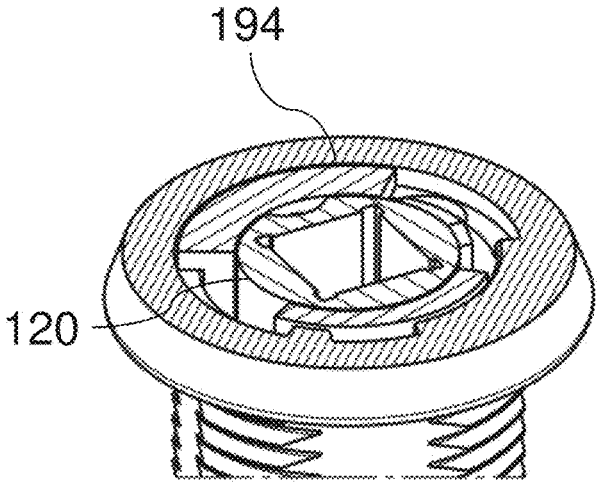
Figure 14C:
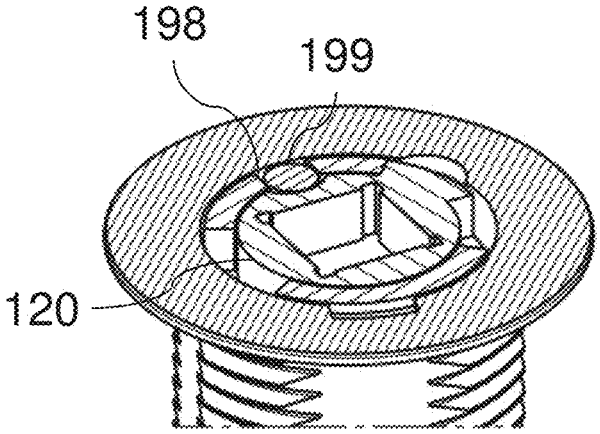

FIGS. 14A-14C show latch 100 in a fourth intermediate position between the opened and closed positions, while cap 120 continues to move bushing 190. In this position, cap 120 has been rotated approximately 110° from the closed position, and bushing 190 has been rotated approximately 65° from the closed position. As cap 120 and cam 160 continue to rotate, the spiral slot 164 of cam 160 continues to apply a force to pin 170 in an axial and circumferential direction. The second portion of the L-shaped slot 154 prevents further movement of pin 170 in the axial direction, but allows movement of pin 170 in the circumferential direction. As a result, continued rotation of cap 120 and cam 160 causes pin 170, and correspondingly shaft 130, to move only in the rotational or circumferential direction. This rotational movement of shaft 130 moves pawl 180 rotationally away from frame 20.

Figure 15A:
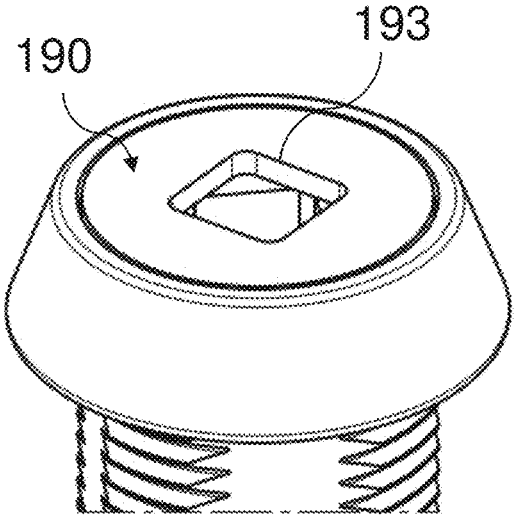
FIGS. 15A-15C depict a sixth step of the opening operation of FIGS. 10A-10C.
Figure 15B:
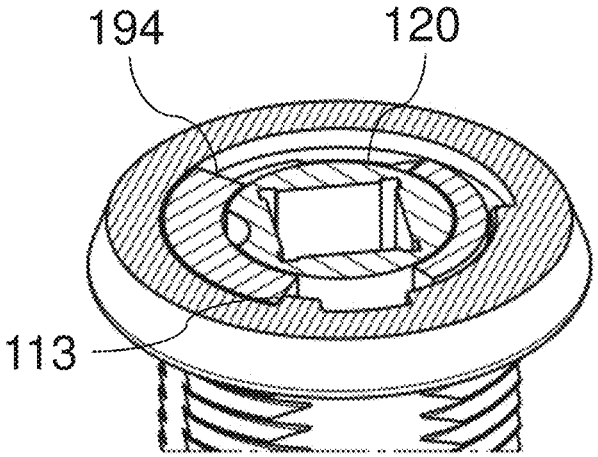
Figure 15C:
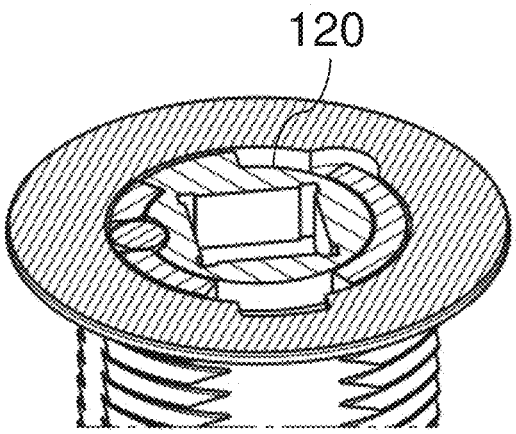

FIGS. 15A-15C show latch 100 in an open position. In this position, cap 120 has been rotated approximately 180° from the closed position, and bushing 190 has been rotated approximately 135° from the closed position. As shown in FIG. 15B, bushing 190 is positioned against stop surface 113 of housing 110, to prevent further rotation of bushing 190 in a counterclockwise direction. Pin 170 reaches the end of slot 154, and no more rotational movement of pin 170 or shaft 130 is possible. In this position, pawl 180 has been fully rotated, and cannot engage frame 20. It will be understood that the rotational distance between the fully open and closed position may be any desired distance.

It will be understood from the above sequence that a closing operation of latch 100 would operate in a similar reversed manner. From the open position of latch 100, key 200 may be rotated to rotate cap 120 in a clockwise direction. As cap 120 rotates, contact between cap 120 and the portion of ball 199 received in cutout area 128 transfers the motion of cap 120 to bushing 190, resulting in a corresponding clockwise rotation of bushing 190. Once bushing 190 arrives at stop surface 111, the contact between cap 120 and ball 199 forces ball 199 out of cutout area 128 and into cutout area 118 of housing 110. At this point, cap 120 is free to rotate relative to bushing 190 until cap 120 contacts stop surface 191. At this point, latch 100 has reached the closed position.

While preferred embodiments of the invention have been shown and described herein, it will be understood that such embodiments are provided by way of example only. Numerous variations, changes and substitutions will occur to those skilled in the art without departing from the spirit of the invention. Accordingly, it is intended that the appended claims cover all such variations as fall within the spirit and scope of the invention.

What is claimed:

1. A latch configured to fix a panel relative to a frame, the latch comprising:

a housing configured for engagement to the panel, the housing having a longitudinal axis and defining an aperture along the longitudinal axis, the aperture including a cutout area;

a cap mounted within the aperture of the housing for rotation about the longitudinal axis, the cap comprising an outer surface including a drive projection and a cutout area;

a bushing mounted within the aperture of the housing for rotation about the longitudinal axis, the bushing comprising an upper surface and a sidewall, the sidewall positioned between the cap and the housing, the sidewall defining a drive surface positioned to contact the drive projection of the cap and an opening; and a ball positioned within the opening of the bushing, the ball configured to be positioned at least partially within the cutout area of the housing or the cutout area of the cap.

2. The latch of claim 1, wherein the cap defines a drive opening extending along the longitudinal axis and forming a drive surface for rotating the cap.

3. The latch of claim 2, wherein the upper surface of the bushing comprises a window overlapping with the drive opening of the cap.

4. The latch of claim 1, wherein the housing comprises a stop surface positioned to block rotation of the bushing in a predetermined direction.

5. The latch of claim 1, wherein the bushing comprises a stop surface positioned to block rotation of the cap in a predetermined direction.

6. The latch of claim 1, wherein the drive projection and the cutout area of the cap are separated by a circumferential distance, and wherein the drive surface and the opening of the bushing are separated by the circumferential distance.

7. The latch of claim 1, wherein the housing and the bushing each comprise an annular groove, and further comprising a retaining ring positioned within the annular groove of the housing and the annular groove of the bushing.

8. The latch of claim 1, further comprising:

a shaft extending along the longitudinal axis within the aperture of the housing, the shaft being mounted for rotation about the longitudinal axis; and a pawl coupled to the shaft, the pawl being configured to engage the frame.

9. A latch configured for movement by a driver between a latched condition to fix a panel relative to a frame and an unlatched condition, the latch comprising:

a housing configured for engagement to the panel, the housing having a longitudinal axis and defining an aperture along the longitudinal axis;

a cap mounted to extend within the aperture of the housing for rotation relative to the housing about the longitudinal axis, the cap having a cap drive surface positioned for contact by the driver; and a bushing mounted to extend within the aperture of the housing for rotation relative to the housing about the longitudinal axis, the bushing defining a window positioned to receive the driver;

wherein the cap and the bushing are configured such that an alignment of the cap drive surface of the cap and the window of the bushing permits insertion or withdrawal of the driver from the cap drive surface of the cap through the window of the bushing when the latch is in the latched condition, and a misalignment of the cap drive surface of the cap and the window of the bushing blocks insertion or withdrawal of the driver from the cap drive surface of the cap through the window of the bushing when the latch is not in the latched condition.

10. The latch of claim 9, wherein the cap is movable in a range of rotational movement relative to the longitudinal axis and the bushing is fixed relative to the longitudinal axis in a portion of the range of rotational movement of the cap.

11. The latch of claim 10, wherein the bushing is movable relative to the longitudinal axis in a portion of the range of rotational movement of the cap.

12. The latch of claim 9, wherein the housing comprises a stop surface positioned to block rotation of the bushing in a predetermined direction.

13. The latch of claim 9, wherein the bushing comprises a stop surface positioned to block rotation of the cap in a predetermined direction.

14. The latch of claim 9, wherein a drive projection and a cutout area of the cap are separated by a circumferential distance, and wherein the drive surface and the opening of the bushing are separated by the circumferential distance.

* * * * *